US006079809A

United States Patent [19]

Yaegashi et al.

[11] Patent Number: 6,079,809

[45] **Date of Patent: *Jun. 27, 2000**

[54] INK JET RECORDING APPARATUS AND METHOD INCLUDING PREVENTION OF COLOR MIXING THROUGH SELECTIVE PREDISCHARGE OF NOZZLES ADJACENT TO DIFFERING COLOR GROUPS

[75] Inventors: Hisao Yaegashi, Kawasaki; Isao Ebisawa, Yokohama; Atsushi Arai, Kawasaki; Hidehiko Kanda, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/518,805

[22] Filed: Aug. 24, 1995

[30] Foreign Application Priority Data

Aug. 26, 1994 [JP] Japan ..... 6-202416
Sep. 27, 1994 [JP] Japan ..... 6-231594

[51] Int. Cl.[7] ..... B41J 2/165

[52] U.S. Cl. ..... 347/35; 347/23

[58] Field of Search ..... 347/24, 23, 35, 347/19, 14, 60

[56] References Cited

U.S. PATENT DOCUMENTS

| | | | |
|---|---|---|---|
| 4,965,608 | 10/1990 | Sshinohara et al. | 346/1.1 |
| 5,021,809 | 6/1991 | Abe et al. | 346/140 R |
| 5,109,233 | 4/1992 | Nishikawa | 346/1.1 |
| 5,164,747 | 11/1992 | Osada et al. | 347/19 |
| 5,166,699 | 11/1992 | Yano et al. | 346/1.1 |
| 5,185,615 | 2/1993 | Koitabashi et al. | 346/1.1 |
| 5,289,207 | 2/1994 | Ebisawa | 346/140 R |
| 5,367,325 | 11/1994 | Yano et al. | 347/17 |
| 5,504,508 | 4/1996 | Hashimoto | 347/24 |
| 5,805,180 | 9/1998 | Ebisawa et al. | 347/23 |

FOREIGN PATENT DOCUMENTS

| | | |
|---|---|---|
| 4-128049 | 4/1992 | Japan . |
| 6-226986 | 8/1994 | Japan . |
| 7-125263 | 5/1995 | Japan . |
| 7-214796 | 8/1995 | Japan . |
| 7-223321 | 8/1995 | Japan . |
| 8-187862 | 7/1996 | Japan . |

*Primary Examiner*—John Barlow
*Assistant Examiner*—Michael S Brooke
*Attorney, Agent, or Firm*—Fitzpatrick, Cella, Harper & Scinto

[57] ABSTRACT

An ink jet recording apparatus comprises a recording head having discharge ports to discharge ink; an ink tank containing ink to be supplied to the recording head; and means for performing predischarges to stabilize ink discharges from the recording head. In this apparatus, the recording head is provided with a discharge unit to discharge plural kinds of ink, and the means for performing predischarges operates predischarges from all the discharge ports, only from the discharges ports in the vicinity of each end of the discharging units, and from all the discharge ports in that order at least for predischarges from discharging unit having relatively thin ink. With such head and means for performing predischarges, it is possible to remove mixed ink after suction recovery with a lesser amount of ink consumption, and execute a high quality recording stably at all times.

10 Claims, 15 Drawing Sheets

INK JET RECORDING APPARATUS AND METHOD INCLUDING PREVENTION OF COLOR MIXING THROUGH SELECTIVE PREDISCHARGE OF NOZZLES ADJACENT TO DIFFERING COLOR GROUPS

BACKGROUND OF THE INVENTION

1. Field of the Invention

The present invention relates to an ink jet recording apparatus for recording by discharging ink from recording means to a recording material, and to a recovery method therefor.

2. Related Background Art

A recording apparatus having the function of a printer, copying machine, facsimile apparatus, or the like, or a recording apparatus used as an output equipment for a complex electronic equipment or a work station including a computer, word processor, or the like, is structured to record images on a sheet, plastic thin plate, or other recording material in accordance with image information. Such recording apparatuses are divided into those of an ink jet type, a wire-dot type, a thermal type, a laser beam type, or some other types in accordance with the recording methods adopted therefor.

Of the recording apparatuses described above, a recording apparatus of an ink jet type (hereinafter referred to as an ink jet recording apparatus) is such as to discharge ink from recording means (hereinafter referred to as a recording head) to a recording material, enabling the compact formation of its recording head; to record highly precise images at high speeds; and also, to record images on an ordinary sheet produced without any particular treatments, thus making it possible to execute recording at lower running costs. Also, being non-impact, the ink jet recording apparatus makes less noises in operation. Further, it is capable of recording color images with ease using ink of multiple colors, among other advantages. Of the ink jet recording apparatuses, particularly the apparatus of a line type, which uses full-multi recording means provided with many discharge ports arranged in the sheet width direction, is structured to be able to perform recording at enhanced speeds.

Then, an ink jet recording apparatus thus structured is further provided with a head recovery system to prevent the occurrence of clogging or the like in the liquid paths thereof. In a state that the discharge port formation surface of the recording head is capped, ink suction is executed by an appropriate sucking means arranged for the head recovery system. Thus, a discharge recovery process is conducted at a specific rate for removing overly viscous ink residing in the liquid paths or the like by causing such ink in the liquid paths to be exhausted forcibly form the ink discharge ports to obtain the enhanced reliability of printing operation.

Also, the recording head used for the ink jet recording apparatus described above is generally structured to be capable of discharging ink of one specific color by use of one recording head. Recently, however, there has been a head structured to be able to discharge ink in multiple colors by use of one and the same head with the provision of liquid chamber of a separate type.

In the latter case where the recording head is structured to discharge ink in multiple colors by use of only one head, it is possible to reduce the numbers of heads that may otherwise be required for printing color images using ink in multiple colors or for multi-level recording by use of ink of a similar color but different densities. In this case, therefore, the apparatus can be fabricated smaller at lower costs.

When an ink suction is operated to prevent the occurrence of head clogging, defective discharges, or the like, there is no possibility at all that any mixture of ink colors takes place after suction as far as only one monochromic ink remains in the interior of a cap to be used for sucking operation. However, in such a case of using a recording head structured to be able to discharge ink in multiple colors within one and the same head with the provision of separated liquid chambers in it, such ink in multiple colors remain in the interior of the cap to be used for sucking operation. Therefore, a problem is encountered that a mixture of ink colors tends to occur when ink is discharged after the recovery by suction.

In order to make the most of a recording head integrally formed for use of multiple colors as described above (that is, to make the main body smaller), it is preferable to arrange a structure so that the same type of a recovery operation as adopted for use of a monochromic head is still made available for a suction or any other recovery operation that is characteristic of an ink jet recording method. In other words, it is desirable to suck ink of all colors from nozzles by one suction for recovery instead of repeating suction several times per color. However, due to incapability of controlling irregular flows of ink in the cap at the time of sucking such recording head as integrally formed for use of multiple colors, there is an irregular occurrence of problem that the ink having been sucked from nozzles used for one color enters the nozzles of the other colors. Also, it is usually practiced that the discharge port surface is wiped by an elastic wiper after suction in order to remove ink and other particles remaining on the discharge port surface of the head. However, this wiping operation causes mixed ink to be pressed so that it may enter the nozzles. These conditions appear as a resultant discoloration (hereafter referred to as mixed colors) on the portion where writing begins in each color after the execution of the recovery.

In order to prevent the occurrence of the mixed colors, there is a need for removing each ink that may result in such mixed colors from the respective nozzles by the application of predischarges. Those amounts of ink to be removed by the application of predischarges are not used for printing directly. In a sense, it is a wasteful use of ink. Therefore, it is desirable to suppress the execution of predischarges to the least possible frequency.

SUMMARY OF THE INVENTION

The inventor et al hereof have studied the possibility to provide means for performing the removal of mixed colors with the least possible consumption of ink after suction, which is applicable to a four-color integrated recording head. As a result, it is found effective to repeat predischarges by combining the predischarges from all the nozzles, and predischarges only from the several nozzles on the respective end portions. The present invention is designed on the basis of such studies and results thereof.

It is one of the objectives of the present invention to provide an ink jet recording apparatus capable of effectuating the removal of mixed colors on the portions where writing begins in each color with the least possible ink consumption when operating the predischarges after suction, which are required to recover the discharge performance of an integrated ink jet recording head for use of multiple colors.

In accordance with the present invention, an ink jet recording apparatus using an integrated ink jet recording head for use of multiple colors is characterized in that after sucking operation, predischarges are executed at least from all the ports for discharging relatively thin ink by discharging such ink therefrom, only from the discharge ports on the end portions of the respective discharge ports, and from all the discharge ports in that order.

In this way, by executing predischarges with comparatively small consumption of ink, it is possible to recover the discharge performance of the recording head, and prevent the occurrence of the mixed colors on the portions where writing begins in each color after the recovery.

Also, in consideration of the technical problems encountered in the prior art, it is another object of the present invention to provide an ink jet recording apparatus capable of recording in high quality stably at all times by effectively removing the mixed colors after suction without consuming ink wastefully for an integrated ink jet recording head of a separated liquid chamber type, which is arranged to discharge ink in multiple colors within one and the same head.

In the ink jet head of a separated liquid chamber type, which is capable of discharging ink in multiple colors within one and the same head, if the negative pressures in the ink tanks for the respective colors are different, ink of other colors are drawn from ink discharge ports to the common liquid chamber through the liquid paths, and are caused to mix with ink of one color in the tank whose negative pressure is the highest; hence mixed colors taking place when ink is sucked from the ink discharge port array capped by capping means.

In accordance with the present invention, however, the negative pressure exerted in the ink tank for each color is detected by controlling means, and after suction by use of capping means, the number of predischarges is changed per ink discharge array for each color in accordance with the differences of negative pressure from the minimum negative pressure in the ink tank. In this way, it is possible to remove the mixed colors after suction without the wasteful use of ink for required predischarges.

DETAILED DESCRIPTION OF THE PREFERRED EMBODIMENTS

Hereinafter, the embodiments will be described in detail in accordance with the present invention.

Figure 1:
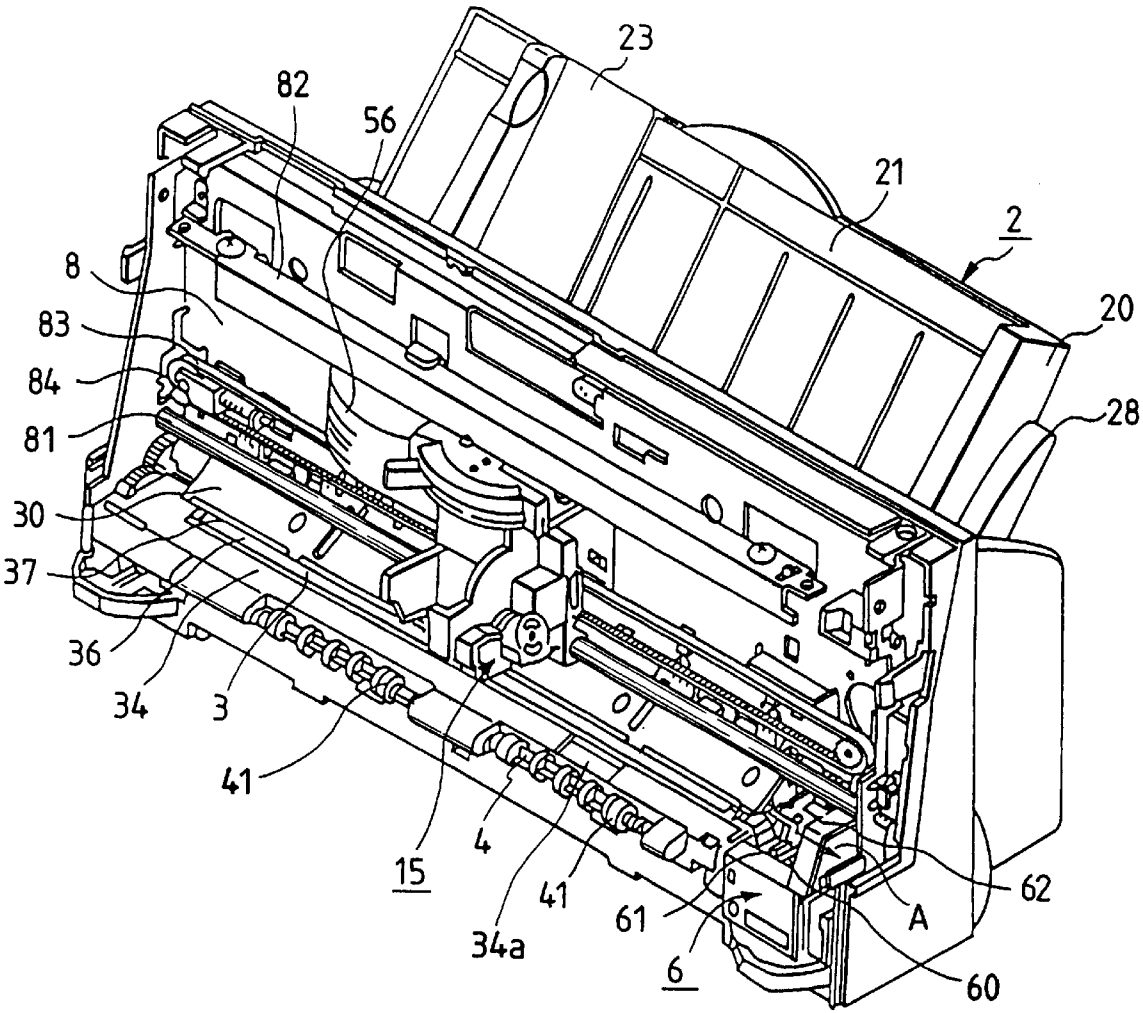
FIG. 1 is a perspective view which shows the entire structure of one embodiment of an ink jet recording apparatus in accordance with the present invention.
Figure 2:
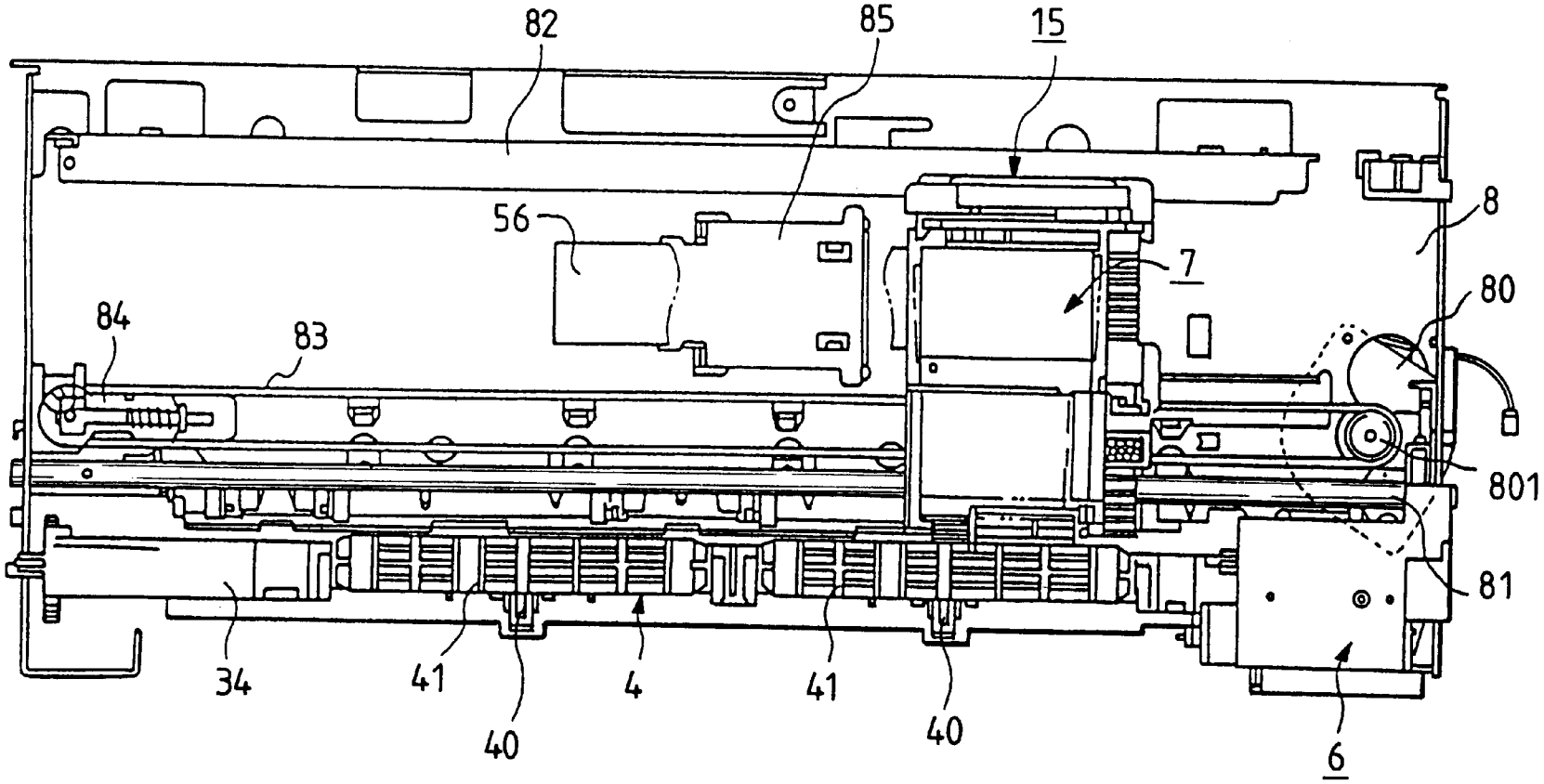
FIG. 2 is a front view which shows the apparatus represented in FIG. 1.
Figure 3:
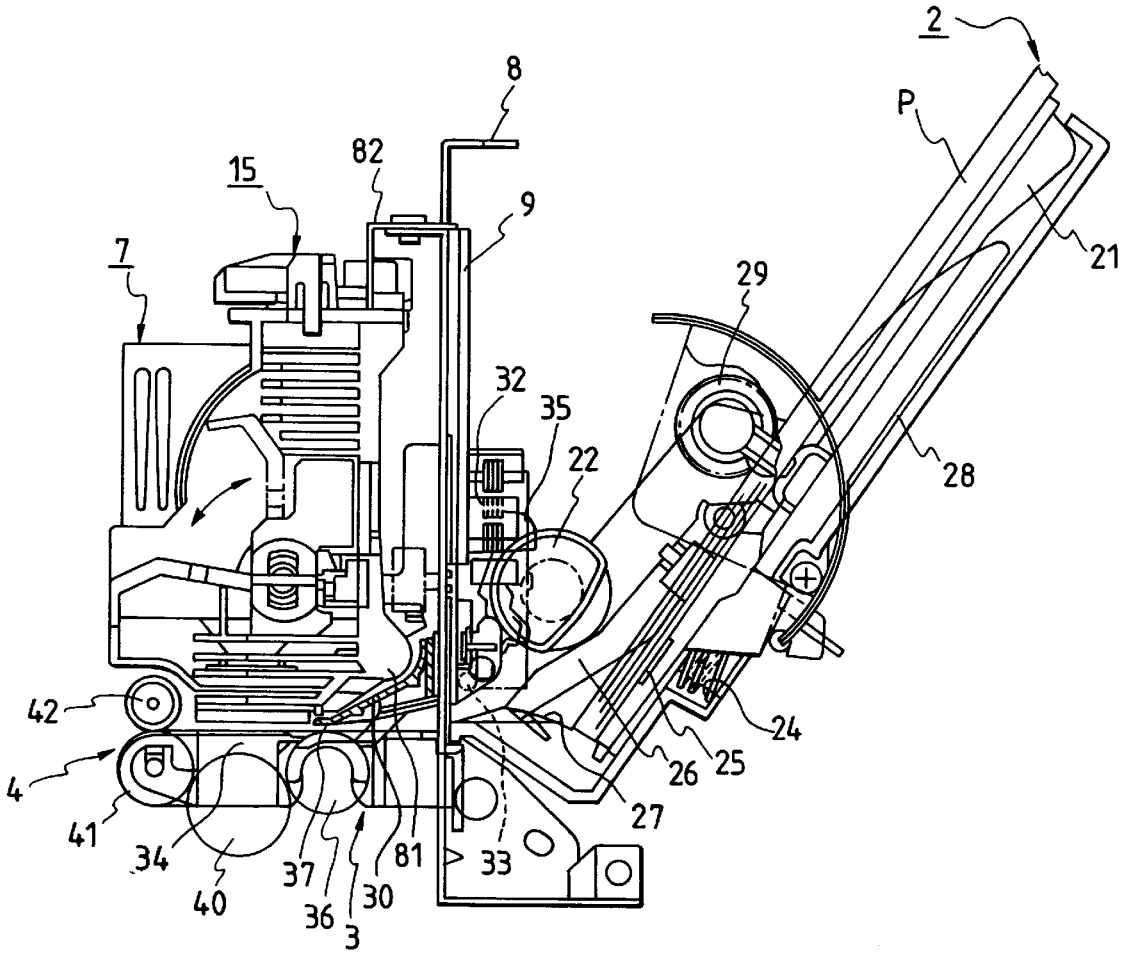
FIG. 3 is a side sectional view which shows the apparatus represented in FIG. 1.

At first, with reference to FIG. 1 to FIG. 3, the description will be made of the schematic structure of one example of an ink jet recording apparatus in accordance with the embodiments of the present invention. FIG. 1 is a perspective view which shows the entire structure of a recording apparatus. FIG. 2 is a front view thereof. FIG. 3 is a side section thereof.

The recording apparatus provided with an automatic sheet feeder comprises a sheet supply unit 2, a sheet feeding unit 3, a sheet exhausting unit 4, a carriage unit 15, and a cleaning unit 6.

The sheet supply unit 2 is structured to fix to a base 20 a pressure board 21 for stacking sheet materials P and a rotary element 22 for supplying and feeding sheet materials P. On the pressure board 21, a movable side guide 23 is movably mounted to regulate the stacking position of the sheet materials P. The pressure board 21 is rotational around the center of the rotary shaft coupled to the base 20, and biased to the supply and feed rotary element 22 by means of a pressure board spring 24. On the location where the supply and feed rotary element 22 and the pressure board 21 face each other, there is provided a separation pad 25 formed by a material having a large friction coefficient such as an artificial leather or the like in order to prevent the sheet materials P from being overlapped when each of them is supplied and fed. Further, on the base 20, there are arranged a separation nail 26 to cover the corners of the sheet material P in one direction and separate the recording sheets P one by one; a bank 27 integrally formed with the base 20 for separating the sheets for which the separation nail 26 cannot be used, such as a thick paper board or the like; a switching lever 28 to set the separation nail 26 so that it functions in a position for use of ordinary sheets or it does not function in a position for use of any thick paper board; and a release cam 29 for releasing the contact between the pressure board 21 and supply and feed rotary element 22.

In the structure described above, the release cam 29 presses down the pressure board 21 to a given position on standby. Thus the contact between the pressure board 21 and the supply and feed rotary element 22 is released, and the driving force is given to a feed roller 36 in this state and transmitted to the supply and feed rotary element 22 and the release cam 29 by means of gears and others. Then the release cam 29 is caused to part from the pressure board 21. The pressure board 21 ascends accordingly to enable the supply and feed rotary element 22 and sheet materials P to be in contact with each other. Each of the sheet materials P is picked up along the rotation of the supply and feed rotary element 22, thus starting its feed, and each of them being separated by means of the separation nail 26 and transferred to the sheet feeder 3 one by one. The supply and feed rotary element 22 and the release cam 29 rotate until the sheet material P is fed into the sheet feeder 3, and then, again on standby to release the contact between the recording sheet P and the supply and feed rotary element 22, thus suspending the transmission of the driving force from the feed roller 36.

The sheet feeder 3 is provided with a feed roller 36 for feeding the sheet materials P and a PE sensor 32. To the feed roller 36, a pinch roller 37 that rotates following the rotation of the feed roller is arranged to be in contact with it. The pinch roller 37 is supported by a pinch roller guide 30 and is biased by means of a pinch roller spring 31. In this way, feeding force is exerted on the sheet materials P by causing the pinch roller 37 to abut upon the feed roller 36. Further, at the entrance of the sheet feeder 3 to which the sheet materials P are being carried, an upper guide 33 and a platen 34 are arranged in order to guide the sheet materials P. Also, on the upper guide 33, a PE sensor lever 35 is arranged to transmit the detection of the leading and trailing ends of each sheet material P to the PE sensor 32, respectively. Further, on the downstream side of the feed roller 36 in the feeding direction of the recording sheets, the head cartridge 7 is arranged to form images in accordance with image information.

With the structure described above, the sheet material P carried to the sheet feeder 3 is guided further by the platen 34, the pinch roller guide 30, and the upper guide 33 to a roller pair formed by the feed roller 36 and the pinch roller 37. At this juncture, the PE sensor lever 35 detects the leading end of the sheet material thus carried and obtains the printing position for the sheet material P. Also, the sheet material P is fed on the platen 34 by the rotation of the roller pair 36 and 37 driven by an LF motor (not shown).

Here, for the head cartridge 7, an ink jet head cartridge is used, which is integrally structured with an ink tank for an easier exchange of heads. The head cartridge 7 is capable of giving heat to ink by means of heaters or the like serving as electrothermal transducing elements. Then, by the heat thus generated, film boiling is generated in ink, and by changes of pressure caused by the development of air bubbles formed by means of the film boiling, ink is discharged from the nozzles 70 of the head cartridge 7 onto the sheet material P for the formation of images.

The carriage unit 5 is provided with a carriage 50 to mount the head cartridge 7 on it. Then the carriage 50 is supported by the guide shaft 81 that enables it to reciprocate in the direction at right angles to the feeding direction (sub-scanning direction) of sheet materials P, as well as the guide rail 82 that holds the rear end of the carriage 50 for the maintenance of a gap between the head cartridge 7 and the sheet material P. In this respect, the guide shaft 81 and the guide rail 82 are fixed to a chassis 8. Also, the carriage 50 is driven by a carriage motor 80 fixed to the chassis 8 through a timing belt 83. The timing belt 83 is tensioned and supported by means of an idle pulley 84. Further, the carriage 50 is provided with a flexible board 51 for the transmission of head signals from an electric board 9 to the head cartridge 7.

In the structure described above, when images are formed on sheet materials P, the roller pair 36 and 37 carries a sheet material P to the line position to form an image (a position in the feeding direction of the sheet material P), and at the same time, the carriage 50 is caused to shift to the column direction to form an image (a position perpendicular to the feeding direction of the sheet material P) by use of the carriage motor 80, thus allowing the head cartridge 7 to face a position to form an image. After that, the head cartridge 7 discharges ink to the sheet material P in accordance with signals from the electric board 9.

The exhaust unit 4 is arranged by a transfer roller 40 that abuts upon the feed roller 36, and then, the transfer roller 40 abuts upon an exhaust roller 41. Therefore, the driving force exerted on the feed roller 36 is transferred to the exhaust roller 41 through the transfer roller 40. Also, a spur 42 abuts upon the exhaust roller 41 so that it can rotate following the rotation of the exhaust roller 41. With the structure described above, the sheet material P, on which images are formed by means of the carriage unit 5, is pinched and carried by the exhaust roller 41 and the spur 42, thus being exhausted onto an exhaust tray or the like (not shown).

The cleaning unit 6 comprises a pump 60 used for cleaning the head cartridge 7; a cap 61 used to suppress the drying of the head cartridge 7; and a driving switching arm 62 for switching the driving force exerted by the feed roller 36 to the driving of the sheet supply unit 2 and the pump 60. The driving switching arm 62 is arranged to fix the planetary gear (not shown), which is rotative around the axial center of the feed roller 36, to a given position unless it engages with sheet feeding or cleaning. In this way, the driving force is not transferred to the sheet supply unit 2 and the pump 60. When the carriage 50 shifts, the driving switching arm 62 moves in the direction indicated by an arrow A. Then the planetary gear becomes free and can shift itself in accordance with the regular or reverse rotation of the feed roller 36. When the feed roller rotates regularly, the driving force is transferred to the sheet supply unit 2, and then, to the pump 60 when the feed roller rotates reversely.

Now, with reference to the accompanying drawings, the description will be made of another example of each principal structure of the ink jet recording apparatuses preferably embodying the present invention.

Figure 4:
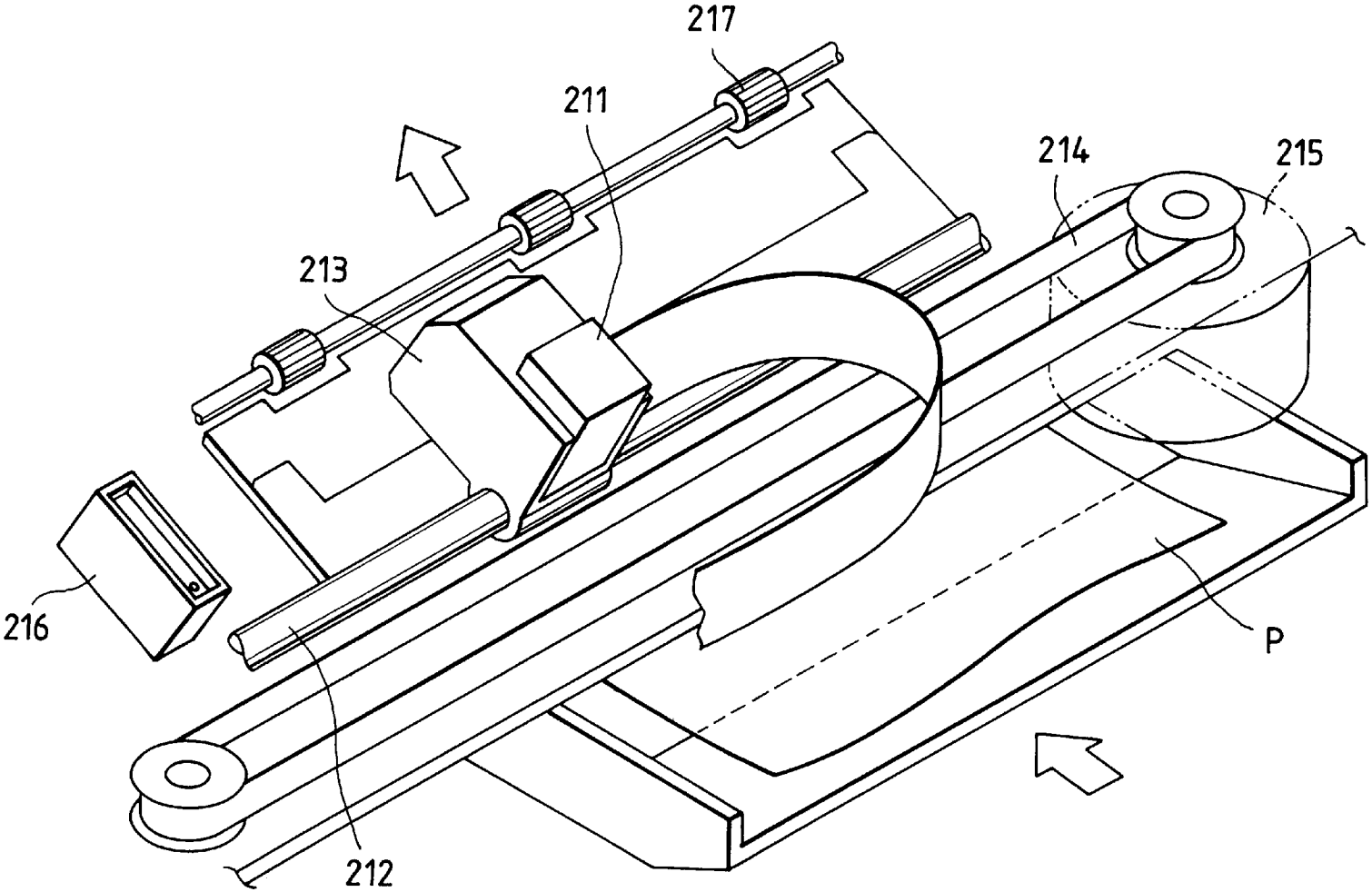
FIG. 4 is a perspective view which shows the principal part of another example of an ink jet recording apparatus in accordance with the present invention.

FIG. 4 is a perspective view which shows another example of the principal structure of ink jet recording apparatuses each in accordance with the present invention.

As shown in FIG. 4, this ink jet recording apparatus is provided with an ink jet head unit 211 (see FIG. 5 and FIG. 6) having discharge port array to discharge ink. The ink jet head unit 211 is installed on a carriage 213. The carriage 213 is slidably supported and guided by means of a guide shaft 212, and coupled to a part of a driving belt 214. The driving belt 214 is tensioned around two pulleys. With either one of the pulleys, the rotational shaft of a carriage motor 215 is connected together with an encoder (not shown). In this way, the carriage 213 is driven by means of the carriage motor 215 to reciprocate along the guide shaft 212 through the driving belt 214.

On the other hand, the recording material P such as a recording sheet or a thin plastic plate is pinched by exhaust rollers 217 after being transferred by means of feed rollers (not shown), and then, carried by the driving of a feed motor (not shown) in the direction indicated by an arrow.

Inside the ink discharge ports (on liquid paths) of the ink jet head unit 211, heat generating elements (electorthermal energy transducing elements) are provided for the generation of thermal energy for use of ink discharges. Then, in accordance with reading timing of the encoder (not shown), the heat generating elements are driven in response to the recording signals, hence flying ink droplets onto the recording material P and causing them to adhere thereto for the formation of images.

On the home position (HP) of the carriage, which is selected outside the recording area, a recovery system is installed with a capping unit 216. When recording is at rest, the carriage 213 is returned to the home position (HP) to airtightly close the ink discharge port formation surface of the ink jet head unit 211 by use of the capping unit 216, thus preventing clogging from being caused by the solidification of ink due to the evaporation of ink solvent, and the adhesion of foreign substances such as dust particles or paper fluffs. Also, the capping function of the capping unit 216 is utilized for a predischarge mode in which ink is discharged into the capping unit 216 having a gap formed by the cap and the ink discharge ports in order to eliminate defective discharges or remove clogging due to the overly viscous ink or solidification thereof occurring on the ink discharge ports making a lesser number of discharges for recording, or utilized for operating a pump (not shown) in a state that the capping is applied to sucking ink from discharge ports for the recovery of the performance of the ink discharge ports having committed defective discharges. Also, a blade is arranged in a position adjacent to the capping unit to make it possible to clean (wipe) the ink discharge port formation surface of the ink jet head unit 211.

Figure 5:
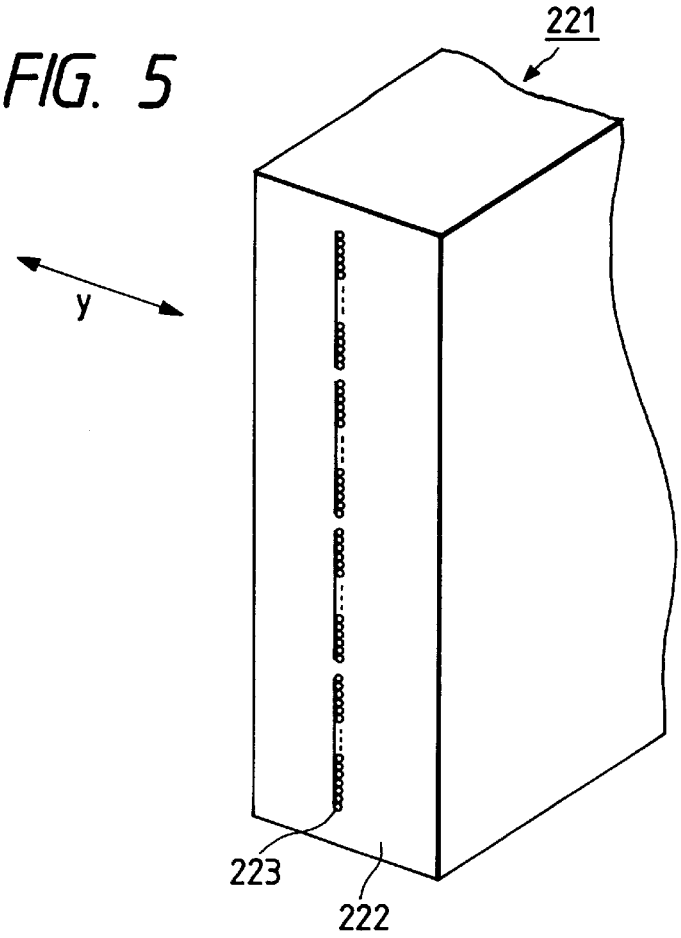
FIG. 5 is a schematically perspective view which shows an ink jet recording head of a separated liquid chamber type capable of discharging ink in multiple colors within one and the same head, which is observed from the ink discharge port array side.
Figure 6:
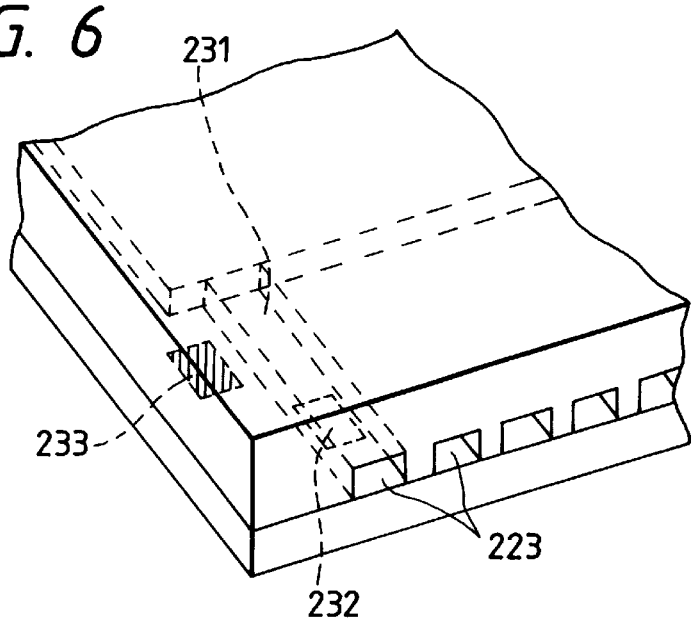
FIG. 6 is a partially perspective view which schematically shows the structure of the ink discharge ports of the ink jet recording head represented in FIG. 5.

FIG. 5 is a schematically perspective view which shows an ink jet recording head of a separated liquid chamber type, which is capable of discharging ink in multiple colors within one and the same head, observed from the ink discharge port array side. FIG. 6 is a perspectively partial view which schematically shows the structure of ink discharge ports of the ink jet recording head represented in FIG. 5.

In FIG. 5 and FIG. 6, the recording head 221 is provided with a discharge port surface 222 having a plurality of opened discharge ports 223 on it. The discharge energy generating elements 232 are arranged respectively for liquid paths 231 connected to the discharge ports 223, and utilized for discharging ink. An arrow y in FIG. 5 indicates the scanning direction of the carriage 213 shown in FIG. 4. In the present embodiment, thermistors 233 are arranged as means for detecting the temperature of the recording head, having each of the liquid paths 231 between them. Such means for detecting the temperature of a recording head is not necessarily limited to the arrangement of thermistors. It may be possible to use diode sensors or the like instead. Further, it may be possible to compute the head temperature in accordance with the duty of printing dots.

Figure 7:
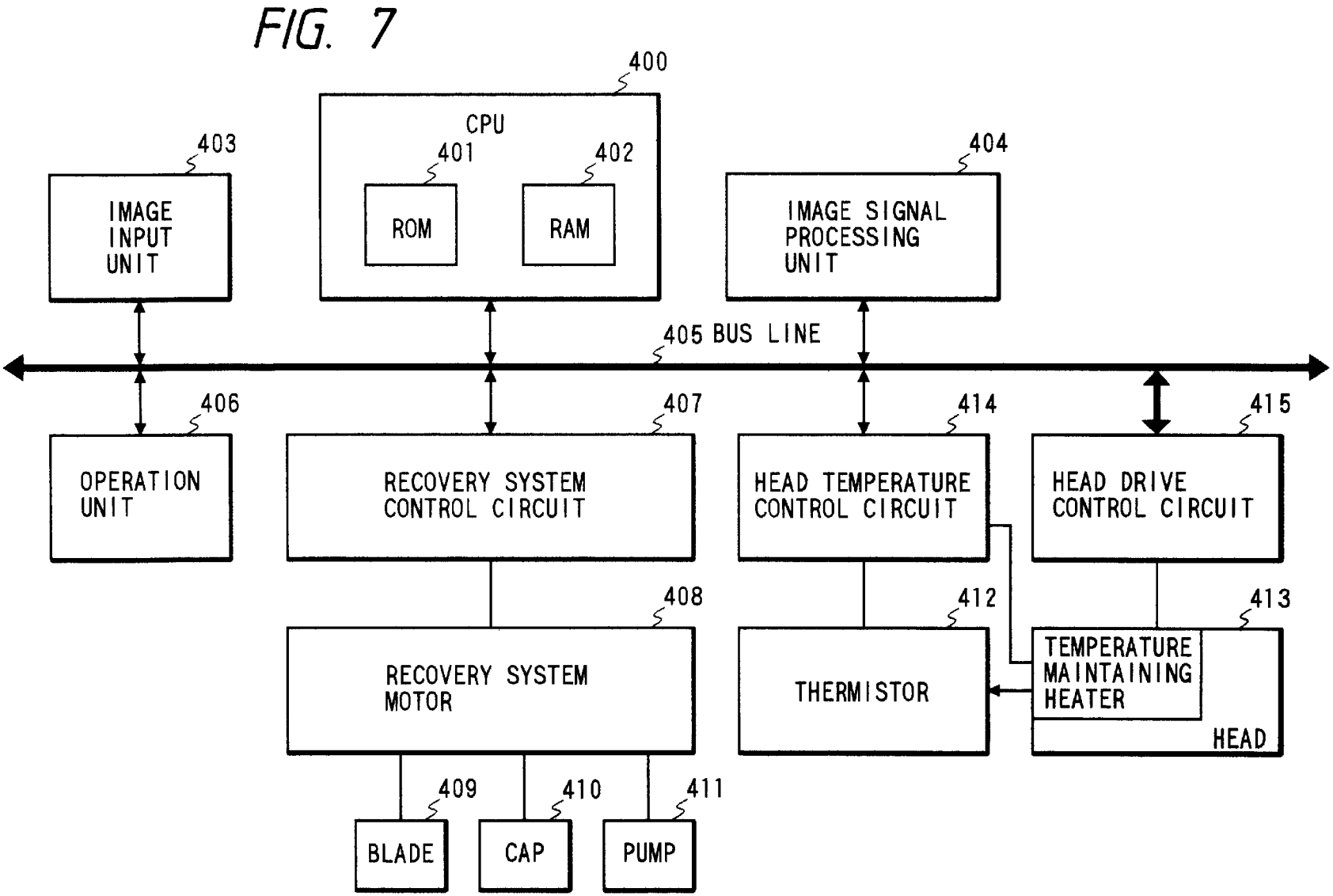
FIG. 7 is a block diagram which shows the control structure of an ink jet recording apparatus in accordance with the present invention.

FIG. 7 is a block diagram which shows the control structure of an ink jet recording apparatus in accordance with the present invention. As shown in FIG. 7, the control structure for the ink jet recording apparatus of the present invention is roughly divided into means for executing processes by use of software system, such as image input unit 403 that is arranged to access main bus line 405, an image signal processor 404 to process each input, and a central controller CPU, and means for executing processes by use of hardware system, such as an operation unit 406, a recovery system control unit 407, a temperature control unit 414 for ink jet head, and a control circuit 415 for head driving.

The CPU 400 is usually provided with a ROM 401 and a random access memory (RAM) 402, and drives the recording head 413 for recording by preparing appropriate recording conditions therefor in accordance with the inputted information. Also, in the RAM 402, a program is stored in advance to execute head recovery operations in accordance with the timing chart prepared therefor so as to provide the predischarge condition and other recovery conditions for the recovery system control circuit 407, recording head, temperature maintaining heater, and the like as required.

The recovery system motor 408 drives the cleaning blade 409, the cap 410, and the suction pump 411, which face or part from the recording head 413 as described earlier.

The head driving control circuit 415 is to drive the electrothermal transducing elements of the recording head 413 to discharge ink in accordance with specific conditions. Usually this circuit drives the recording head 413 to perform predischarges or discharge ink for recording.

On the other hand, the temperature maintaining heater is arranged on the base board where the electrothermal transducing elements are provided for the recording head 413 to discharge ink so that the temperature of ink in the recording head is heated or adjusted to a desired level of temperature.

Likewise, the thermistors 412 are arranged on the base board to measure the substantial temperature of ink in the recording head. It may be possible to arrange the thermistors 412 outside the base board, not necessarily on it. It may also be arranged in the vicinity of the circumference of the recording head.

(Embodiment 1)

Figure 8:
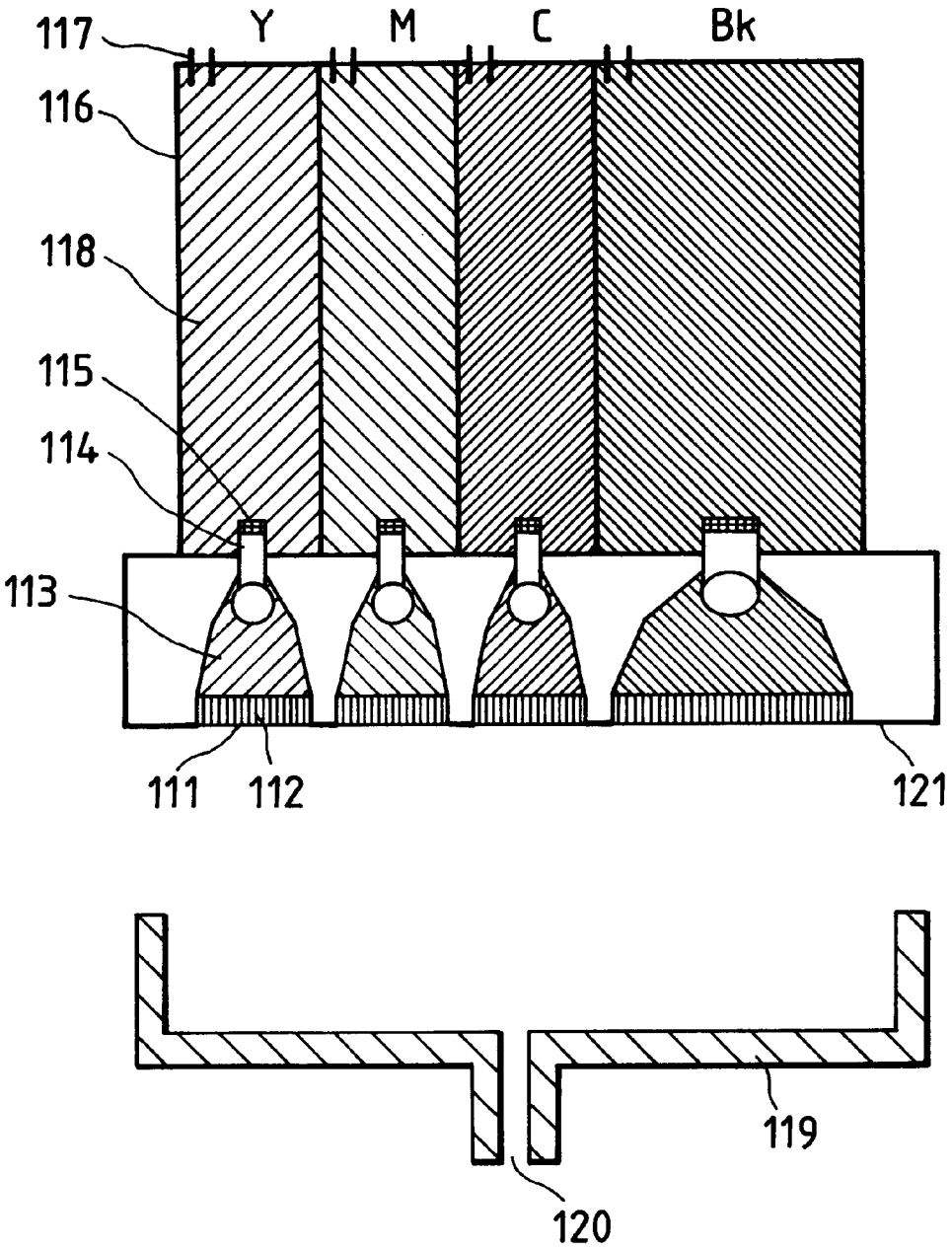
FIG. 8 is a schematically across-sectional view which illustrates a head cartridge installed on an ink jet recording apparatus in accordance with the present invention.

FIG. 8 is a cross-sectional view schematically showing an ink jet recording head installed on an ink jet recording apparatus in accordance with the present invention.

There are arranged on one line, 24 nozzles for discharging yellow ink (hereinafter referred to as an yellow nozzle array), 24 nozzles for discharging magenta ink (hereinafter referred to as a magenta nozzle array), 24 nozzles for discharging cyan ink (hereinafter referred to as a cyan nozzle array), and 64 nozzles for discharging black ink (hereinafter referred to as a black nozzle array). Between each of the color nozzle arrays, a gap equivalent to eight nozzles is arranged. Each nozzle array is provided with ink to be supplied from the common liquid chamber 113 for each color. To each of the common liquid chambers, ink is supplied from each color ink tank 116, respectively.

This recording head is capable of continuously discharging color ink droplet of approximately 40 ng, and black ink droplet of approximately 80 ng at 6.25 kHz maximum.

Figure 9:
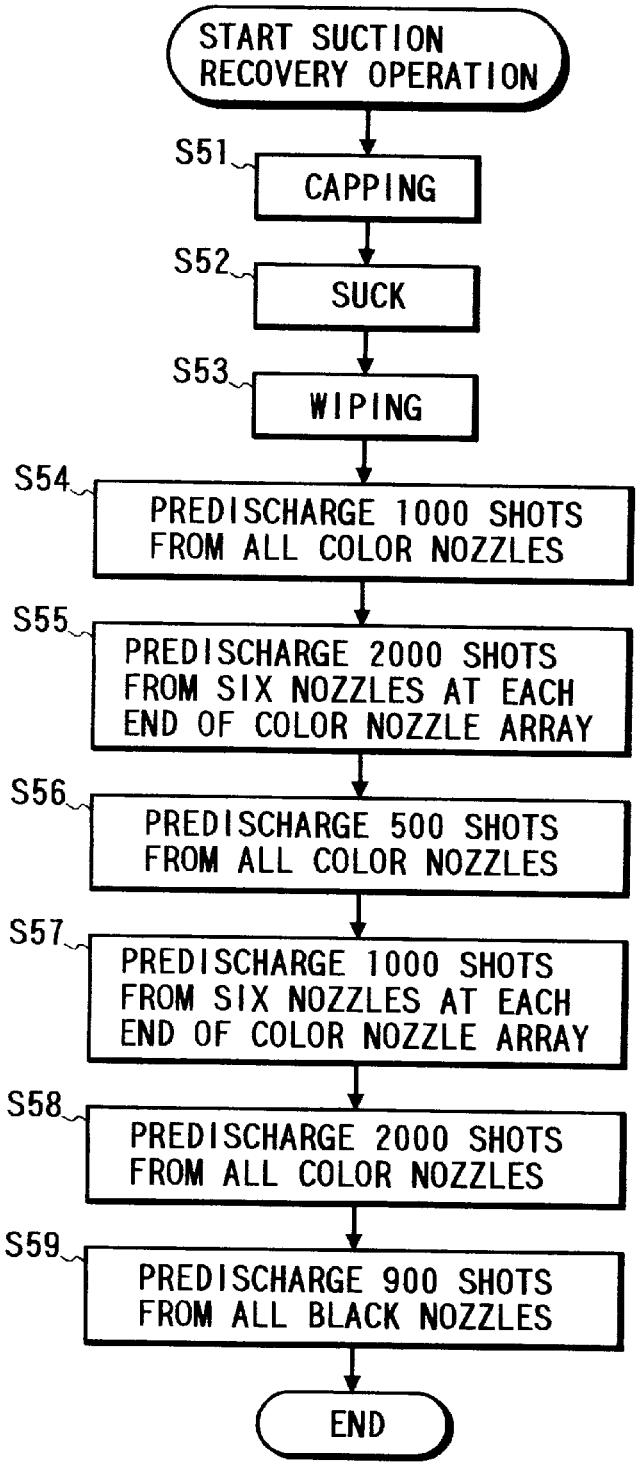
FIG. 9 is a flowchart which shows an example of recovery sequence in accordance with the embodiment 1 of the present invention.

FIG. 9 shows the sequence of a suction recovery for an ink jet recording apparatus in accordance with the present embodiment. After suction and wiping are executed (steps S51 to S53), a predischarge of 1,000 shots is performed for all color nozzles (yellow, magenta, and cyan) at 6.25 kHz (step S54). Then, a predischarge of 2,000 shots is performed from six nozzles at each end of color nozzle arrays at 6.25 kHz (step S55), and then, a predischarge of 500 shots is performed from all color nozzles at 6.25 kHz (step S56). Subsequently, a predischarge of 1,000 shots is performed from six nozzles at each end of color nozzle arrays at 6.25 kHz (step S57), and a predischarge of 2,000 shots is performed from all color nozzles at 6.25 kHz (step S58), thus terminating the color predischarge operation after suction.

Figure 11:
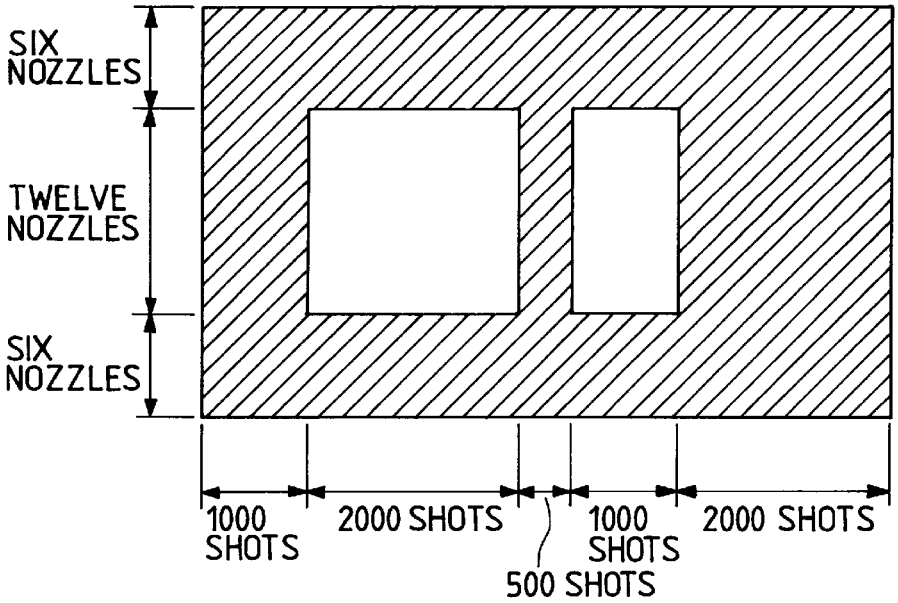
FIG. 11 is a view which shows a printed pattern to illustrate the operation of one embodiment in accordance with the present invention.

FIG. 11 illustrates the pattern of predischarges in colors described above, which is prepared for an easier understanding of the operation.

For black ink, a predischarge of 900 shots is performed from all the nozzles at 6.25 kHz. With this, its predischarge after suction is terminated. In the present embodiment, the black predischarge is performed after the color predischarges have been terminated, but it may be possible to execute it at the same time of the color predischarges being effectuated as described above.

In accordance with the studies made by the inventor et al hereof, the degrees of mixed colors are more conspicuous at the end portion than in the central portion of each color nozzle array. Probably, this is because the amount of ink having entered the nozzles is greater at the end portion closer to the nozzles of another color, and also because compared to ink residing in the central part of the common liquid chamber, ink staying near the wall of the common liquid chamber is harder to move so that the ink of another color that has entered is not easily drawn out. These two reasons are conceivable in this respect.

Here, therefore, by conducting the predischarge from the nozzles at the end portions of the color nozzle arrays more often than the predischarge from the nozzles in the central portions thereof, it is possible to remove the mixed colors with a smaller amount of ink consumption. Further, it is possible to effectively remove the mixed colors with a smaller amount of ink consumption in total by repeating the predischarge from the nozzles at the end portion and that from all the nozzles in combination. The mechanism leading to this fact does not seem to be clear, but the behaviors of ink flows in each of the color liquid common chambers are different depending on whether all the nozzles are in use or only the nozzles at the end portions are in use. Conceivably, therefore, when the changes resulting from this difference are repeatedly made, the mixed colors are more easily removed efficiently.

Further, in order to enhance the effect of the predischarges from the nozzles at the end portions, it may be possible to apply the driving conditions that may lead to a greater discharge amount at the time of each predischarge being effectuated only for the nozzles at the end portions.

Also, it may be possible to modify the conditions of predischarge depending on the kinds of colors, not necessarily making such conditions equal to all the colors. For example, it may be possible to increase the predischarge amount of ink in yellow more than other colors because yellow is more conspicuous in the mixed colors.

Using a recording apparatus of the present embodiment the examination is repeated 100 times to print on a recording sheet after having operated the suction recovery. There have never been observed any discoloration (mixed colors) in the portion where writing begins.

COMPARATIVE EXAMPLE

Using the same recording apparatus as the embodiment 1, a predischarge of 3,500 shots is performed from all the color nozzles (yellow, magenta, and cyan) at 6.25 kHz, and then, the suction recovery sequence is modified so that a predischarge of 3,000 shots is performed from six nozzles at each of the end portions of the color nozzle arrays at 6.25 kHz. For black ink, the same predischarge is performed as the embodiment 1.

In this case, the shot number of the predischarges (that is, the amount of ink consumption) is exactly the same as the embodiment 1. What differs is that there is no repetition of the predischarge from all the nozzles and the predischarges from the six nozzles at each end portion.

Using a recording apparatus of the present embodiment the examination is repeated 100 times to print on a recording sheet after having operated the suction recovery. The discoloration (mixed colors) has been observed twice out of the 100 times in the portion where writing begins. There is noted a tendency that the mixed colors of the kind occur more easily when ink remains become smaller in the ink tanks.

(Embodiment 2)

In an ink jet recording apparatus in accordance with a second embodiment of the present invention, the predischarges are performed in the same manner as the embodiment 1 to implement the suction recovery. In this case, however, the predischarges using all the nozzles are conducted at 2 kHz.

By use of this recording apparatus, the examination is repeated 100 times to print on a recording sheet after having operated the suction recovery. No discoloration (mixed colors) has occurred on the portion where writing begins.

(Embodiment 3)

Figure 10:
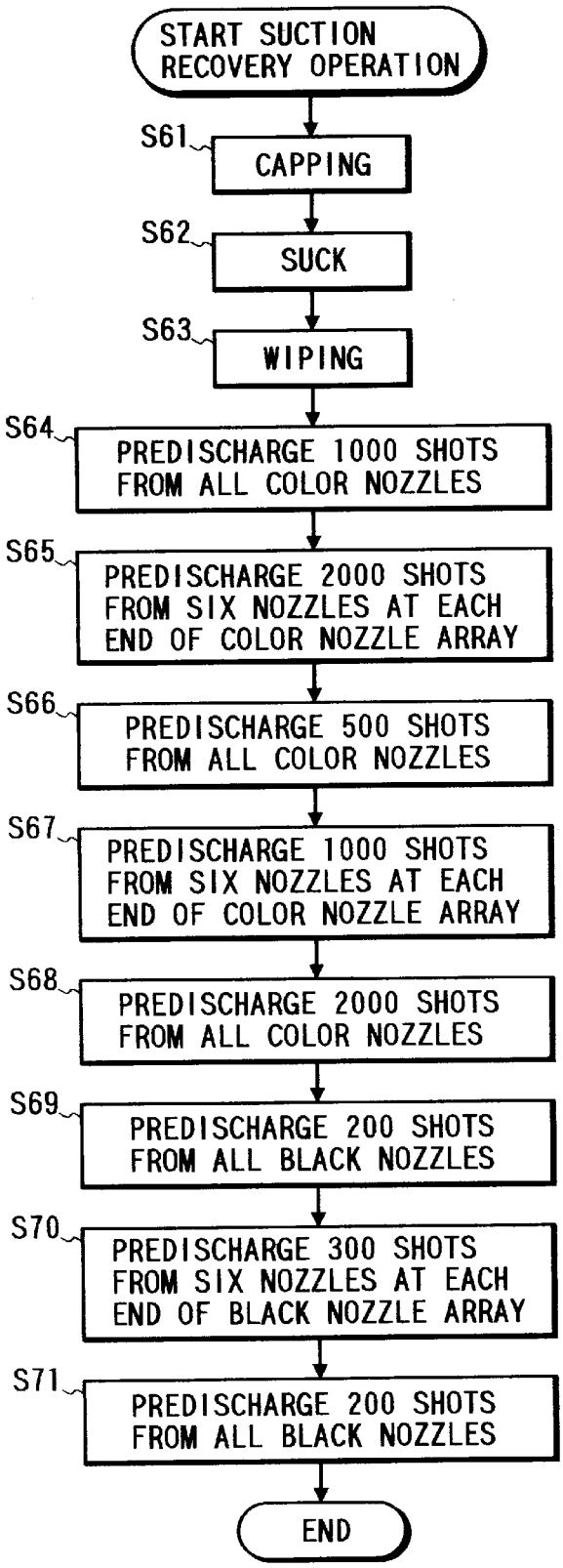
FIG. 10 is a flowchart which shows an example of recovery sequence in accordance with the embodiment 3 of the present invention.

In an ink jet recording apparatus in accordance with a third embodiment of the present invention, wiping is executed after suction as shown in FIG. 10 (steps S61 to S63), and the black discharges are performed (steps S69 to S71) subsequent to the color predischarges in the same manner as the embodiment 1 (steps S64 to S68) to implement the suction recovery sequence.

For the black predischarges, a predischarge of 200 shots is performed from all the nozzles at 6.25 kHz (step S69), and a predischarge of 300 shots is performed from six nozzles at the end portion at 6.25 kHz (step S70), and then, a predischarge of 200 shots from all the nozzles at 6.25 kHz (step S71).

Using this recording apparatus, the examination is repeated 100 times to print on a recording sheet after having operated the suction recovery. No discoloration (mixed colors) has occurred on the portion where writing begins.

(Embodiment 4)

Figure 12:
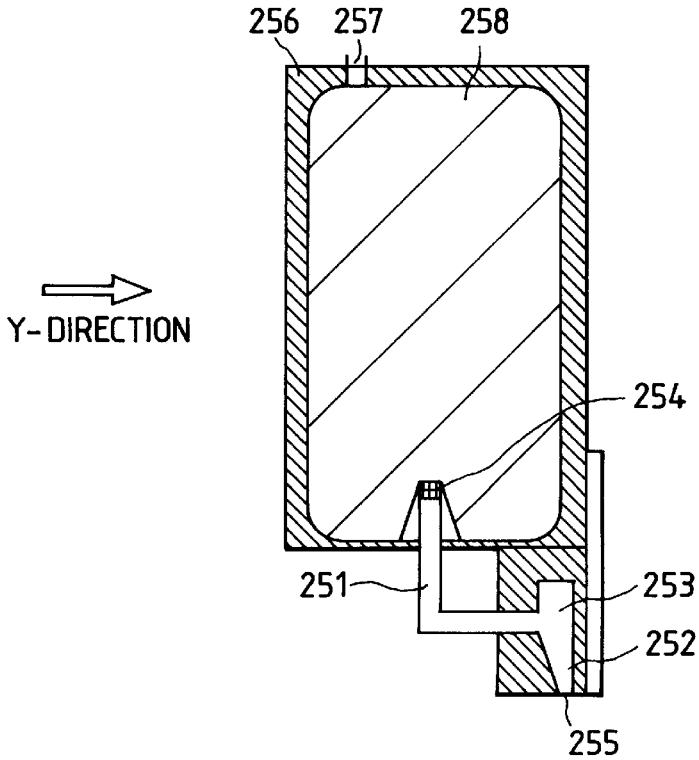
FIG. 12 is a view which schematically shows the structure of an ink jet recording head of a separated liquid chamber type capable of discharging ink in multiple colors within one and the same head, and an ink tank in accordance with the embodiment 4, observed in the direction of the discharge ports to be arranged.
Figure 13:
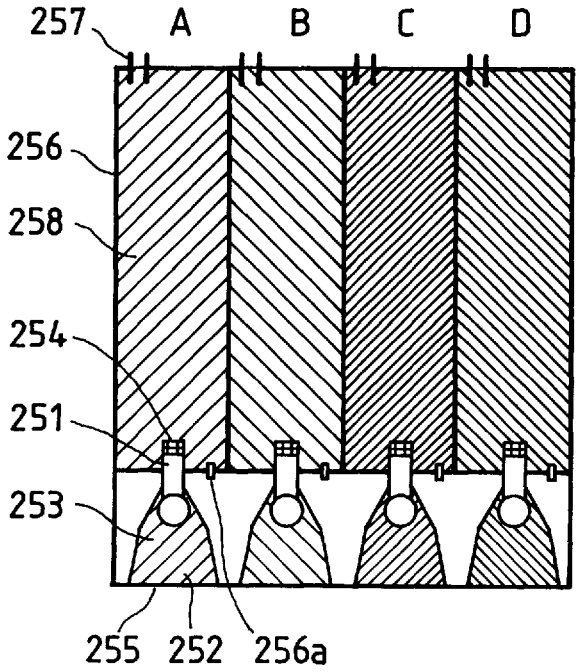
FIG. 13 is a schematically structural view which shows the ink jet recording head observed in the direction Y in FIG. 12.

FIG. 12 is a view which schematically shows, in accordance with a fourth embodiment of the present invention, the structure of an ink jet recording head of a separate liquid chamber type capable of discharging ink of multiple colors within one and the same head, and the structure of ink tank therefor, observed in the direction of the discharge ports being arranged. FIG. 13 is a view which schematically shows the structure of the ink jet recording head and ink tank, observed in the direction Y in FIG. 12.

As shown in FIG. 12 and FIG. 13, the structure is arranged to connect the head and the ink tank 256 provided with air conduction apertures 257 for the replacement of ink with outside air, and also, provided with absorbent 258. The ink supply is made to the interior of the head from the ink tank 256 to the common liquid chamber 253 conductively connected to the liquid path 252 by way of the ink supply path 251 through the filter 254 to trap the dust particles in ink; here, in the liquid path 252, the heaters for use of ink discharges are arranged inside the ink discharge ports. Then, by arranging four separated common liquid chambers, it is possible to discharge ink in A color, B color, C color, and D color from one head. In this respect, the four colors, A to D, may be black, cyan, magenta, and yellow or four similar colors having different densities of ink dyes. When executing suction for this head, four colors are sucked at a time by means of one cap to be used for the purpose. Therefore, if the negative pressures are different in each of the ink tanks arranged for the four colors, mixed colors or improper densities are caused to occur because ink of other colors enter the ink tank of a color whose negative pressure is higher through the ink discharge ports 155 to the common liquid chamber 253 by way of the liquid path 252.

Figure 14:
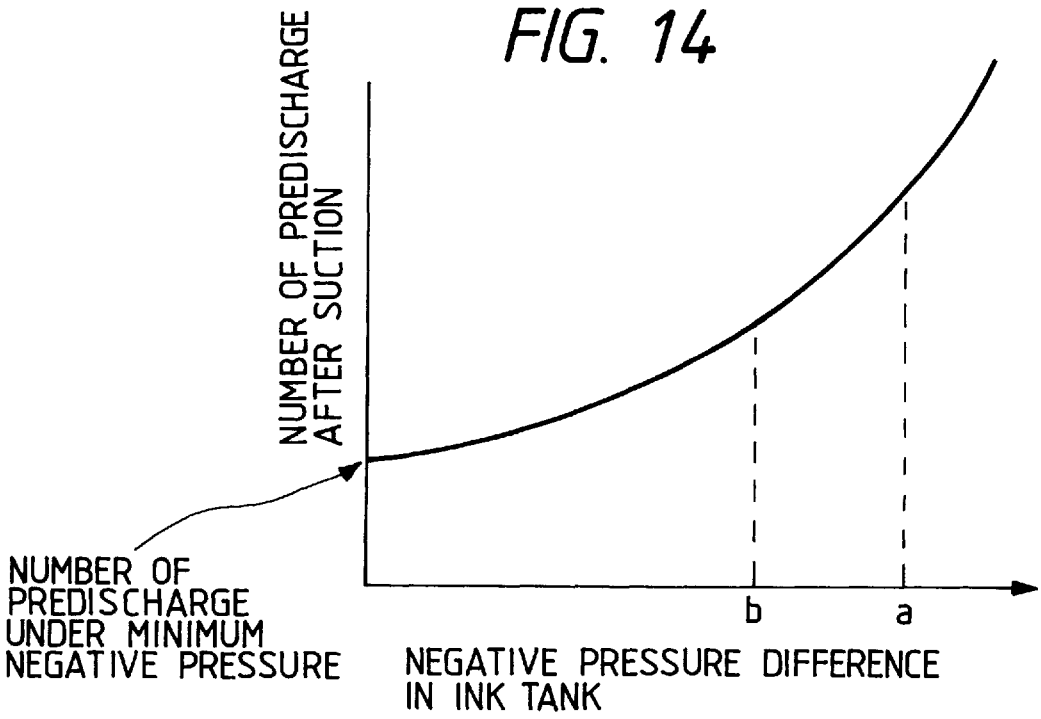
FIG. 14 is a graph which shows the results of examination on the differences of negative pressure from the minimum negative pressure in the ink tank, and the numbers of predischarges required for the removal of ink in mixed colors after suction.

FIG. 14 is a graph which shows the results of examination on the differences of negative pressure from the minimum negative pressure in the ink tank, and on the number of predischarges required for removing ink in mixed colors after suction. In other words, it is understandable that there is a tendency that the greater the differences of negative pressure from the minimum negative pressure in the ink tank, the more the number is increased for the predischarges required to remove the ink in mixed colors.

Figure 15:
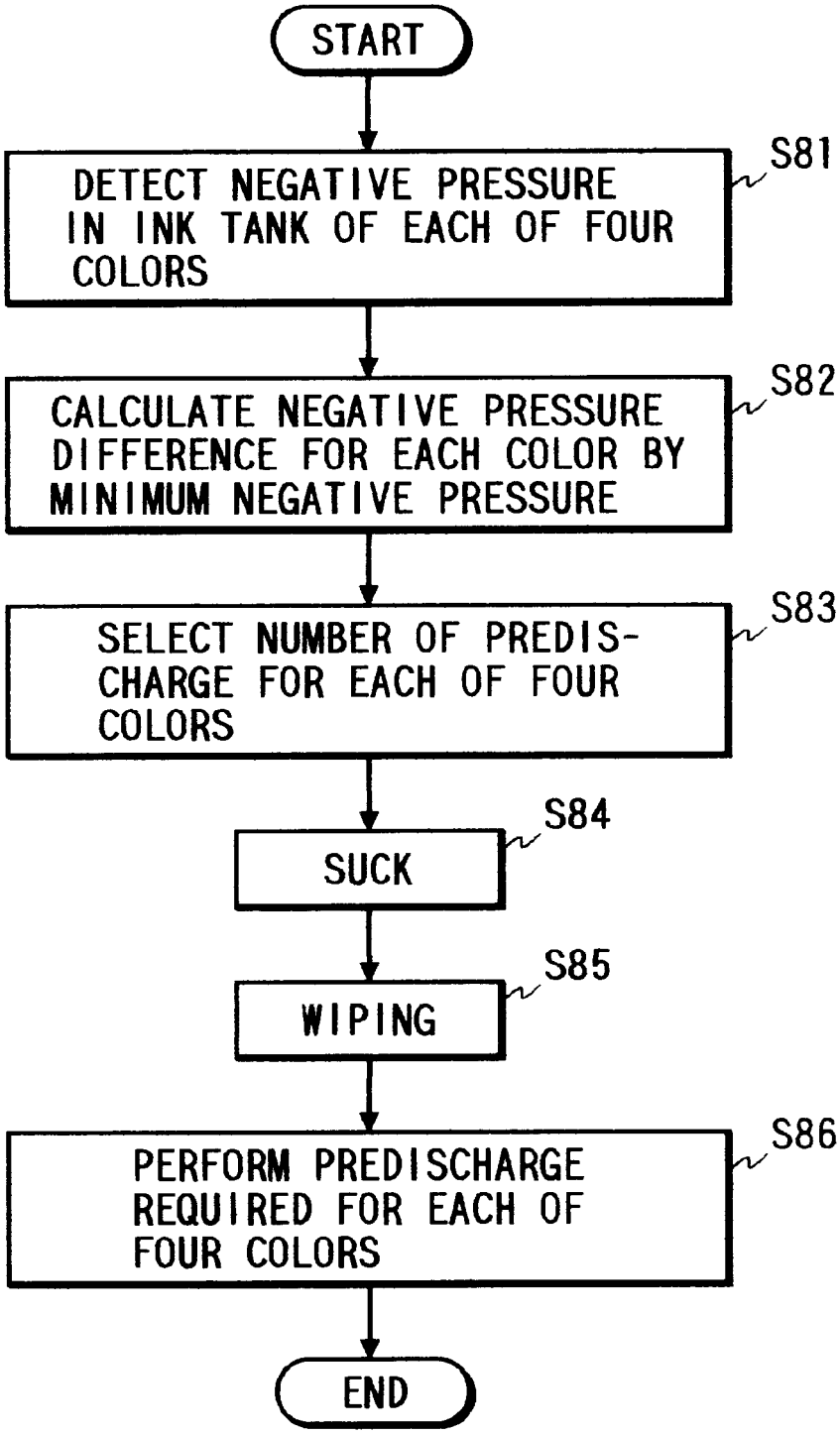
FIG. 15 is a flowchart which shows a head recovery operation in accordance with the embodiment 4 of the present invention.
Figure 16:
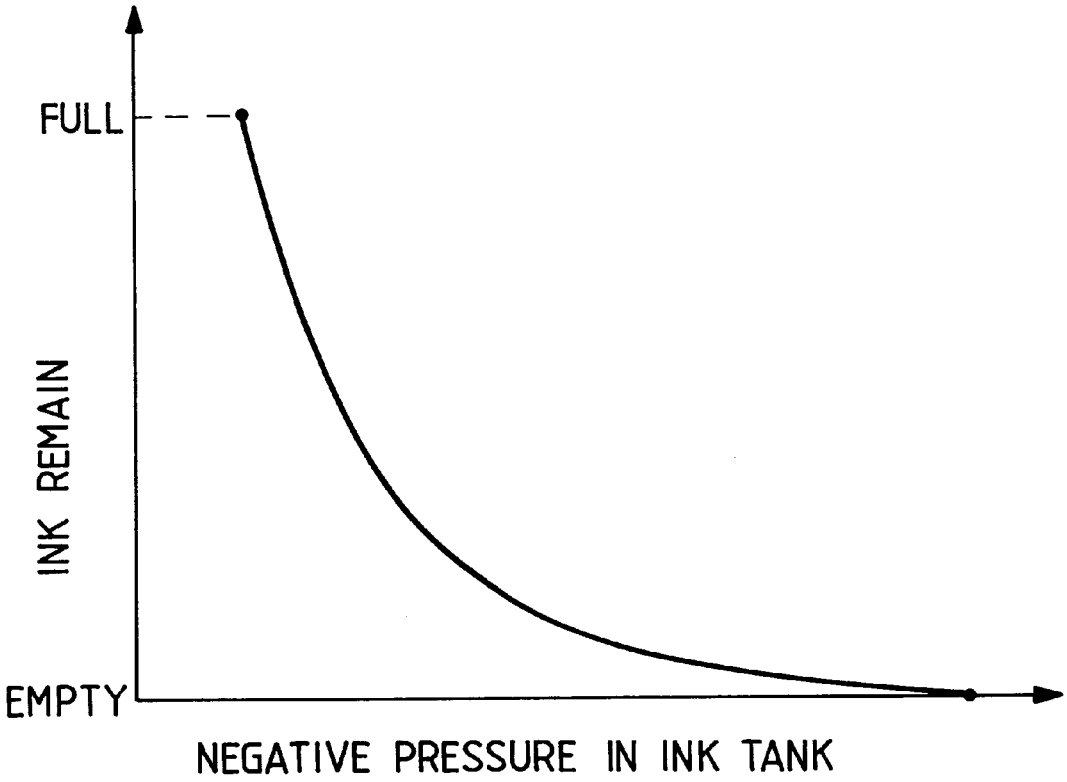
FIG. 16 is a graph which shows the results of examination on the negative pressures in an ink tank containing an absorbent to hold ink, and the ink remains in the ink tank.

FIG. 15 is a flowchart which shows a head recovery operation in accordance with the embodiment 4 of the present invention. FIG. 16 is a graph which shows the results of examination on the negative pressures on an ink tank containing absorbent to hold ink, and on ink remains in the ink tank.

In FIG. 15, it is assumed that the operation STARTs when a button is depressed to actuate a head recovery. At first, the negative pressure in each ink tank is detected by means of a negative pressure detector 256*a* for each of four colors A to D (step S81). Then each of the differences of negative pressure from the minimum negative pressure in the ink tank is calculated (step S82).

Thus, from the relationship between the differences of negative pressure in the ink tank, and the number of predischarges required to remove the mixed colors after suction as shown in FIG. 14, the required number of predischarges is selected for one color whose negative pressure is minimum as well as for each of remaining three colors (step S83). After that, suction (step S84), and wiping (step S85) are performed to clean off ink or the like adhering to the ink discharge port formation surface, and then, the predischarges are executed (step S86) for each of the four colors in the numbers selected in the step S83. Thus, it is assumed that the END indicates a printing on standby.

In this respect, as means for detecting the negative pressure of each ink tank referred to in the step S81 in FIG. 15, it may be possible to use means for estimating the negative pressure in each ink tank by detecting the ink remains on the basis of the relationship shown in FIG. 16.

As described above, in accordance with the embodiment 4, it is possible to control after suction the predischarges in each color to the optimal numbers of performance in order to reduce the amount of ink consumption, hence preventing the mixed colors efficiently to execute a high quality recording stably at all times, even when using an ink jet recording head capable of discharging ink in four colors with the provision of four separated liquid chambers.

Also, in this respect, the description has been made of the case where the liquid chamber is divided into four to make it possible to discharge in four colors, but the present invention is not necessarily limited to four colors. It is applicable to an ink jet recording head capable of discharging ink in two colors, three colors or five or more colors.

Also, the negative pressure referred to in the present embodiment is an electrostatic negative pressure as well as a dynamic negative pressure to be exerted at the time of recovery operation.

(Embodiment 5)

In a fifth embodiment, too, the description will be made using an ink jet recording head capable of discharging ink in four colors with the four divided liquid chambers and ink tank as shown in FIG. 12 and FIG. 13.

Figure 17:
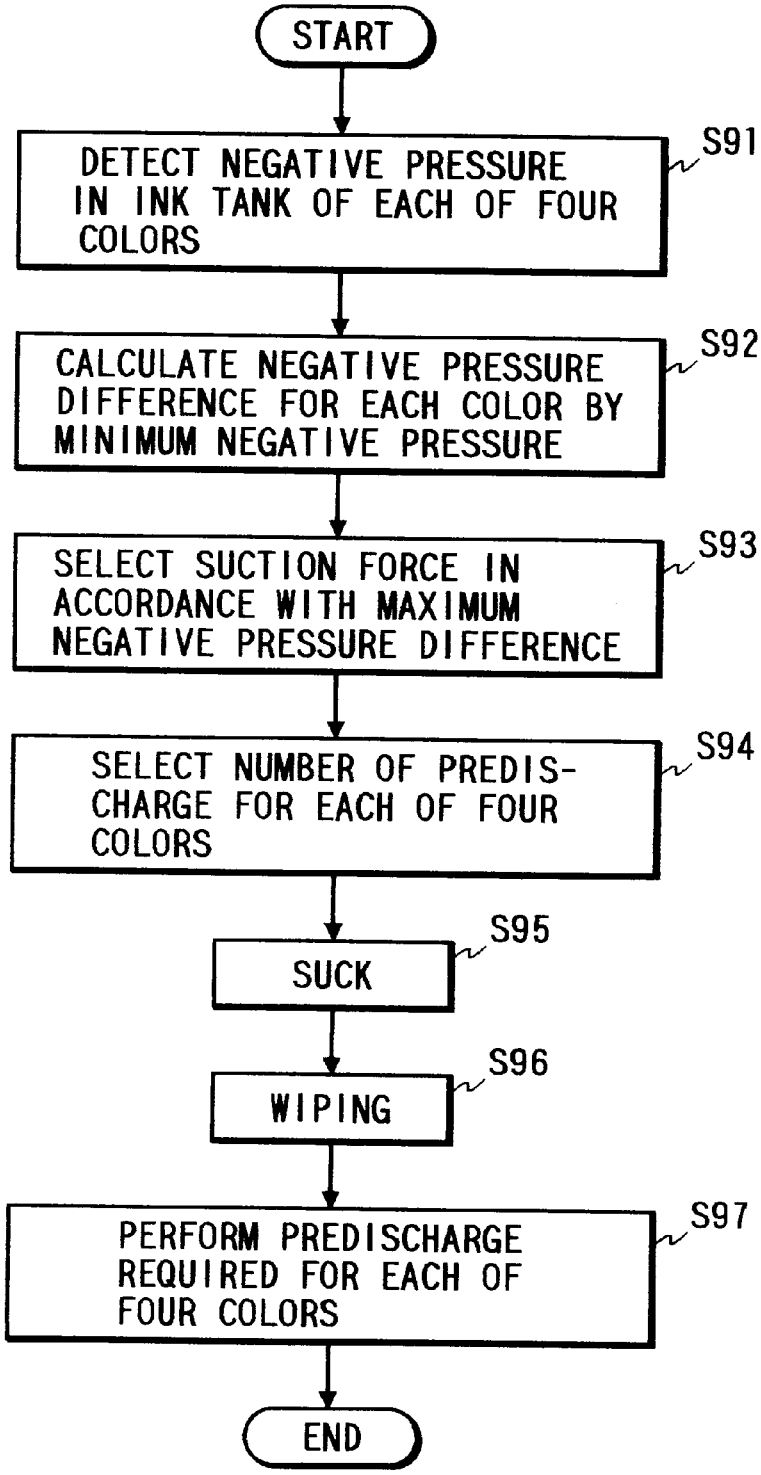
FIG. 17 is a flowchart which shows a recovery operation in accordance with the embodiment 5 of the present invention.

FIG. 17 is a flowchart which shows a recovery operation in the embodiment 5 in accordance with the present invention.

In FIG. 17, it is assumed that the operation STARTs when a button is depressed to actuate a head recovery. At first, the negative pressure in each ink tank is detected by means of a negative pressure detector for each of four colors A to D (step S91). Then, each of the differences of negative pressure from the minimum negative pressure in the ink tank is calculated (step S92).

Thus, the suction force is selected (step S93) corresponding to the value of the maximum negative pressure difference among the differences of negative pressure thus obtained, and then, the number of predischarges is selected for each of four colors in accordance with the suction force and the differences of negative pressure in the ink tanks (step S94). After the suction is executed (step S95) in a sucking amount required for the performance of the recovery by the application of the suction force that has been selected in the step S93, ink or the like adhering to the ink discharge port formation surface is cleaned by wiping (step S96), and then, the predischarges are executed (step S97) in the respective numbers selected in the step S94 for each of the four colors. Thus, it is assumed that the END indicates a printing on standby.

In this respect, as means for detecting the negative pressure of each ink tank referred to in the step S81 in FIG. 15, it may be possible to use means for estimating the negative pressure in each ink tank by detecting the ink remains on the basis of the relationship shown in FIG. 16.

Now, from the relationship between the differences of negative pressure from the minimum negative pressure in the ink tank, and the number of predischarges required for the removal of ink of the mixed colors after suction, the differences of negative pressure a and b are compared. Then, it is understandable that the greater the difference of negative pressure between them, the more the number is increased for the predischarges required to remove ink in mixed colors after suction.

Figure 18:
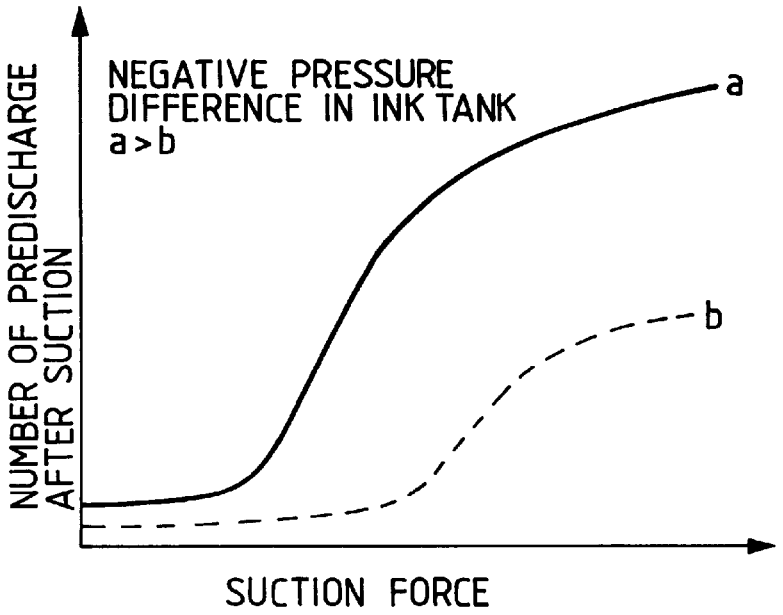
FIG. 18 is a graph which shows the results of examination on the suction force for executing the sucking operations at a and b in FIG. 14 where the difference of the negative pressure in the ink tank is a>b.

FIG. 18 is a graph which shows the results of examination on the suction force to operate suction for a and b in FIG. 14 where the difference of negative pressure in the ink tanks is a>b, and on the number of predischarges required for the removal of ink in mixed colors.

It is possible to reduce the numbers of predischarges after suction by executing the sucking operations with a lower suction force both for a and b. It is understandable from FIG. 18 that the predischarge numbers after suction cannot be in a balanced state unless the suction force given to the a, where the difference of negative pressure is greater in the ink tank, is lower than the suction force given to the b.

From this point of view, the suction force is selected in the step S93 in FIG. 17 so that the predischarge numbers after suction is in a balanced state subsequent to the suction conducted at the maximum difference of negative pressure obtained in the step S92.

In the step S94 in FIG. 17, the numbers of the predischarges are selected (step S93) for one color in the minimum negative pressure and for each of the remaining three colors in accordance with the relationship between the differences of negative pressure in the ink tank indicated in FIG. 14 regarding the suction force selected in the step S93, and the numbers of predischarges required to remove ink in mixed colors after suction.

As described above, in the embodiment 5, it is possible to efficiently prevent the mixed colors after suction with a smaller amount of ink consumption, and execute a high quality recording stably at all times. Also, in this respect, it may be possible to define in advance the suction force to be applied to the sucking operation in accordance with the difference of maximum negative pressure that may be exerted, thus setting the numbers of predischarges after suction to be in a balanced state.

In this respect, the negative pressure referred to in the present embodiment is an electrostatic negative pressure as well as a dynamic negative pressure to be exerted at the time of recovery operation.

(Embodiment 6)

Figure 19:
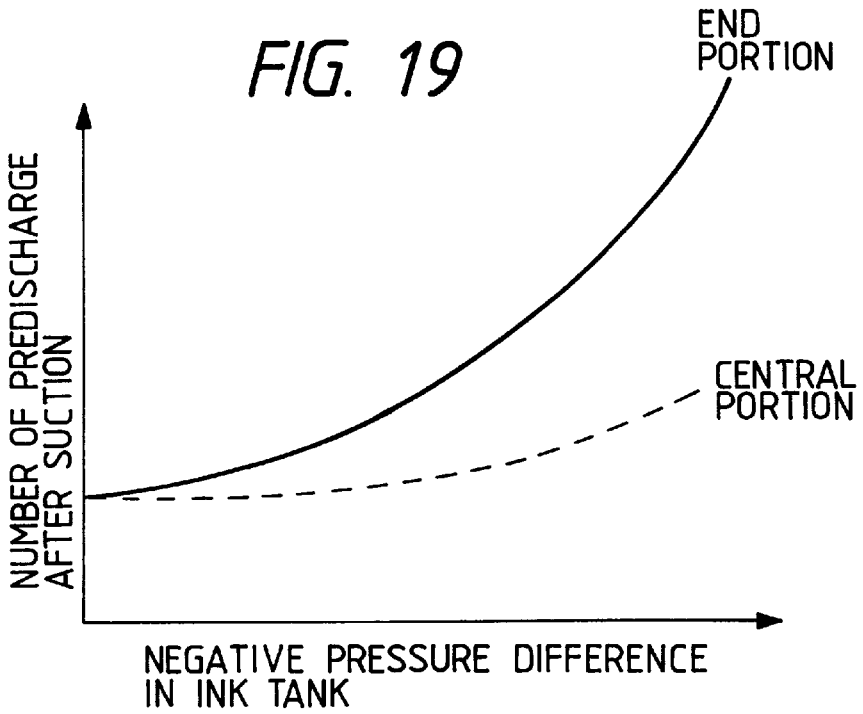
FIG. 19 is a graph which shows the results of examination on the differences of negative pressure from the minimum negative pressure in the ink tank, and the numbers of predischarges required for the removal of ink in mixed colors after suction on the end and central portions of the ink discharge port array.

FIG. 19 is a graph which shows the results of examination on the differences of negative pressure from the minimum negative pressure in the ink tank, and on the numbers of required predischarges on the end portions and central parts of each ink discharge port array to remove ink in mixed colors after suction.

It has also been clear from FIG. 13 that there is tendency that the greater the differences of negative pressure in the ink tank, the more the numbers are increased for the predischarges required to remove ink in mixed colors after suction. From FIG. 19, it is understandable that the number of predischarges on each central part is smaller than that of predischarges on each end portion of the ink discharge ports.

From these results of examinations in the embodiment 6, it is understandable that the occurrence of mixed colors after suction is prevented extremely efficiently with still smaller amount of ink consumption when the numbers of predischarges are selected for recovery operations as shown in FIG. 15 and FIG. 17 by defining the number of predischarges to be smaller in each central part of the ink discharge port array. In this way, it is possible to execute a high quality recording stably at all times.

In this respect, the negative pressure referred to in the present embodiment is an electrostatic negative pressure as well as a dynamic negative pressure to be exerted at the time of recovery operation.

What is claimed is:

1. An ink jet recording apparatus comprising:

a recording head having a plurality of discharge ports to discharge an ink, said recording head comprising a plurality of discharge units to discharge a plurality of kinds of the ink;

an ink tank containing said inks that are supplied to said recording head; and predischarging means for performing predischarges to stabilize subsequent discharges of inks from said recording head, said predischarging means first causing predischarges from all the discharge ports, next causing predischarges from only those of the discharges ports in a vicinity of each end of the discharging unit, and then causing predischarges from all the discharge ports in that order at least for predischarges from the discharging unit having a relatively thin ink.

2. An ink jet recording apparatus according to claim 1, wherein said means for performing predischarges operates the predischarges according to claim 1 after suction recovery for an ink jet recording apparatus comprising a recording head having discharge ports to discharge ink; an ink tank containing said ink to be supplied to said recording head; and means for performing predischarges to stabilize ink discharges from said recording head.

3. An ink jet recording apparatus comprising;

a recording head having a plurality of discharge ports to discharge an ink, said recording head comprising a plurality of discharge units to discharge a yellow ink, a magenta ink and a cyan ink;

an ink tank containing said inks that are supplied to said recording head; and predischarging means for performing predischarges to stabilize subsequent discharges of inks from said recording head, said predischarging means operating after a suction recovery and first causing predischarges from all the discharge ports, next causing predischarges from only those of the discharge ports in a vicinity of each end portion of color discharge unit, next causing predischarges from all the color discharge ports, next causing predischarges from only those of the discharge ports in a vicinity of each end portion of the color discharge units, and then causing predischarges from all the color discharge ports.

4. An ink jet recording apparatus comprising:

a recording head having a plurality of discharge ports to discharge an ink, said recording head having a plurality of discharge units to discharge a plurality of kinds of the ink and a nozzle array for discharging a yellow ink, a magenta ink, a cyan ink, and a black ink;

an ink tank containing said inks that are supplied to said recording head; and predischarging means for performing predischarges to stabilize subsequent discharges of inks from said recording head, said predischarging means operating after a suction recovery and first causing predischarges from all the color nozzles, next causing predischarges from only six of the nozzles disposed on each end portion of the color discharge units, then causing predischarges from all the color nozzles, next causing predischarges from only from six of the nozzles on each end portion of the color discharge units, and then causing predischarges from all the color nozzles.

5. An ink jet recording apparatus according to either one of claim 1 to claim 4, wherein said recording head is provided with a plurality of discharge units to discharge ink, and means for generating thermal energy arranged for each of the corresponding discharge units to exert change of states in ink by the application of heat, and form flying droplets by discharging ink from said discharge units in accordance with said change of states.

6. An ink jet recovery method for performing recovery and maintenance of an ink discharge condition of an ink jet head having a plurality of discharge units, each said discharge unit comprising a plurality of discharge ports for discharging an ink different from each other to record and a common ink chamber for storing the ink that is supplied to said discharge ports, said method comprising the steps of:

causing all of said discharge ports of said discharge units to discharge the ink in a manner so as not to record;

causing an end predischarge in which only those of said discharge ports which are communicated with an end of each of said common ink chambers of said discharge units discharge the ink in a manner so as not to record; and then repeating the first step of causing all of said discharge ports of said discharge units to discharge the ink in a manner so as not to record.

7. A method according to claim 6, wherein said said step of causing all of said discharge ports of said discharge units to discharge the ink and said step of causing end predischarge are repeated plural times in this order.

8. A method according to claim 6, further comprising a step of providing the plurality of said discharge ports communicating with an end of said common ink chamber.

9. A method according to claim 6, further comprising a step of using thermal energy to discharge the ink through said discharge ports.

10. An ink jet recovery method for performing recovery and maintenance of an ink discharge condition of an ink jet head having a plurality of discharge units, each said discharge unit comprising a plurality of discharge ports for discharging an ink different from each other to record and a common ink chamber for storing the ink that is supplied to said discharge ports, said method comprising the steps of:

causing an end predischarge in which only those of said discharge ports which are communicated with an end of each of said common ink chambers of said discharge units discharge the ink in a manner so as not to record;

causing all of said discharge ports of said discharge units to discharge the ink in a manner so as not to record; and then repeating the first step of causing the end predischarge in which only those of said discharge ports which are communicated with an end of each of said common ink chambers of said discharge units discharge ink in a manner so as not to record.

* * * * *

UNITED STATES PATENT AND TRADEMARK OFFICE

CERTIFICATE OF CORRECTION

PATENT NO. : 6,079,809

DATED : June 27, 2000

INVENTOR(S) : HISAO YAEGASHI ET AL.

It is certified that error appears in the above-identified patent and that said Letters Patent is hereby corrected as shown below:

ON COVER PAGE AT [56] U.S. PATENT DOCUMENTS

"Sshinohara et al." should read --Shinohara et al.--.

ON COVER PAGE AT [57] ABSTRACT

Line 11, "unit" should read --units--.

COLUMN 1

Line 27, "from" should read --from a--;
Line 35, "noises" should read --noise--;
Line 51, "form" should read --from--;
Line 58, "of" should read --of a--.

COLUMN 2

Line 4, "for" should read --long--;
Line 9, "remain" should read --remains--;
Line 10, "for" should read --for the--;
Line 25, "of" should read --of a--;
Line 46, "et al" should read --et al.--.

COLUMN 3

Line 61, "across-sectional" should read --cross-sectional--.

UNITED STATES PATENT AND TRADEMARK OFFICE

CERTIFICATE OF CORRECTION

PATENT NO. : 6,079,809

DATED : June 27, 2000

INVENTOR(S) : HISAO YAEGASHI ET AL.

It is certified that error appears in the above-identified patent and that said Letters Patent is hereby corrected as shown below:

COLUMN 4

Line 57, "20 a" should read --20 of a--.

COLUMN 8

Line 10, "of" should read --of a--;
Line 13, "of" should read --of a--.

COLUMN 9

Line 22, "et al" should read --et al.--;
Line 61, "have" should read --has--.

COLUMN 11

Line 40, "of" should read --of the--.

COLUMN 13

Line 58, "discharges ports" should read --discharge ports--.

UNITED STATES PATENT AND TRADEMARK OFFICE

CERTIFICATE OF CORRECTION

PATENT NO. : 6,079,809

DATED : June 27, 2000

INVENTOR(S) : HISAO YAEGASHI ET AL.

It is certified that error appears in the above-identified patent and that said Letters Patent is hereby corrected as shown below:

COLUMN 14

Line 16, "unit," should read --units,--;
Line 38, "from" (second occurrence) should be deleted;
Line 66, "said" (first occurrence) should be deleted.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*